US007703551B2

(12) United States Patent
Reagan

(10) Patent No.: US 7,703,551 B2
(45) Date of Patent: Apr. 27, 2010

(54) FLUID DRIVEN DRILLING MOTOR AND SYSTEM

(75) Inventor: Loren Peter Reagan, Calgary (CA)

(73) Assignee: Bow River Tools and Services Ltd., Calgary (CA)

( * ) Notice: Subject to any disclaimer, the term of this patent is extended or adjusted under 35 U.S.C. 154(b) by 321 days.

(21) Appl. No.: 11/449,677

(22) Filed: Jun. 9, 2006

(65) Prior Publication Data

US 2006/0283636 A1 Dec. 21, 2006

Related U.S. Application Data

(60) Provisional application No. 60/692,265, filed on Jun. 21, 2005.

(51) Int. Cl.
*E21B 4/02* (2006.01)

(52) U.S. Cl. ..... 175/107; 175/324

(58) Field of Classification Search ..... 175/107, 175/324

See application file for complete search history.

(56) References Cited

U.S. PATENT DOCUMENTS

| | | | | | |
|---|---|---|---|---|---|
| 2,340,738 | A | * | 2/1944 | Dilley | 175/95 |
| 3,960,456 | A | | 6/1976 | Norris | |
| 3,982,859 | A | | 9/1976 | Tschirky et al. | |
| 4,479,558 | A | * | 10/1984 | Gill et al. | 175/320 |
| 4,485,880 | A | | 12/1984 | Makohl | |
| 4,880,066 | A | | 11/1989 | Steiginga et al. | |
| 5,007,490 | A | | 4/1991 | Ide | |
| 5,135,059 | A | | 8/1992 | Turner et al. | |
| 5,375,662 | A | | 12/1994 | Echols, III et al. | |
| 5,385,407 | A | * | 1/1995 | De Lucia | 384/97 |
| 5,577,564 | A | * | 11/1996 | Le | 175/93 |
| 5,655,607 | A | | 8/1997 | Mellemstrand et al. | |
| 5,816,324 | A | | 10/1998 | Swearingen et al. | |
| 6,364,038 | B1 | | 4/2002 | Driver | |
| 6,419,021 | B1 | | 7/2002 | George et al. | |
| 6,561,290 | B2 | | 5/2003 | Blair et al. | |
| 6,568,489 | B1 | | 5/2003 | Hailey | |
| 6,569,020 | B1 | | 5/2003 | Falgout, Sr. | |
| 6,897,578 | B1 | * | 5/2005 | Olsen et al. | 290/52 |

FOREIGN PATENT DOCUMENTS

| | | |
|---|---|---|
| CA | 2172498 | 4/1995 |
| CA | 2413124 | 12/2001 |
| CA | 2197964 | 12/2002 |

* cited by examiner

*Primary Examiner*—David J Bagnell
*Assistant Examiner*—Robert E Fuller
(74) *Attorney, Agent, or Firm*—Antony C. Edwards

(57) ABSTRACT

A fluid driven drilling motor and system includes a flex shaft between the rotor and a cylindrical flow collar. The end of the flow collar opposite from the flex shaft has a bore in fluid communication with a drill bit. Ramped apertures are formed in the side wall of the flow collar. The ramped apertures are in fluid communication with the bore. Drilling fluid flowing under pressure down past the flex shaft is directed and drawn into the ramped apertures along a fluid flow path which spirals downwardly and radially inwardly of the flow collar so as to then flow into the bore. The pressure loss associated with drawing the drilling fluid down to the drill bit is thereby minimized.

8 Claims, 6 Drawing Sheets

FLUID DRIVEN DRILLING MOTOR AND SYSTEM

CROSS REFERENCE TO RELATED APPLICATION

This application claims priority from U.S. Provisional Patent Application No. 60/692,265 filed Jun. 21, 2005 entitled Fluid Driven Drilling Motor and System.

FIELD OF THE INVENTION

The present invention relates to the field of drilling systems, and more particularly, it relates to an improved mud motor.

BACKGROUND OF THE INVENTION

Conventional rotary drilling operations rotate the drill bit by turning the entire drill string at the surface with a rotary table and kelly. However, a down-hole motor, such as a down-hole mud motor, utilizes the circulation system and the hydraulic power of a drilling fluid to rotate the drill bit without rotating the entire drill string within the well bore. A down-hole mud motor system may include drill collars which are larger diameter pipes attached to the drill pipe at a lower end of the drill string above the drill bit wherein the drill collar helps to add weight to the drill string to ensure there is sufficient downward pressure to enable the drill bit to drill through the formation. The drill bit, located at the bottom end of the drill string is responsible for breaking up and dislodging the rock formation as small rock particles suspended in the fluid as it is pumped back to the surface from the drill bit. There are different types of drill bits, such as diamond bits, steel tooth bits, and carbide insert bits to handle different drilling conditions, such as the type of underground formation, the type of drilling, and the temperature of the Earth.

A mud motor is typically used in directional drilling operations, especially in oil and gas and mining operations. Mud motors are usually used to rotate a drill bit for bore hole drilling and coring in the earth. The rotor of the motor rotates the drill bit with respect to a stator which is connected to a drill string. The weight of the drill bit and drill string in conjunction with the rotary speeds generated by the mud motor enables the rotating drill bit to efficiently cut away the formation the drill bit is pushed against. Drilling fluid, such as so-called "mud", supplies the hydraulic power to operate the motor. More particularly, the mud motor operates by converting the hydraulic energy of the drilling fluid into mechanical torque and applying the torque to drive the drill bit into the formation.

The additional main functions of the drilling fluid include cooling and lubricating the drill bit, stabilizing the wall of the well bore, controlling well pressure, and removing debris and cuttings. The composition of the mud drilling fluid used for any particular drilling operation depends on the drilling conditions. The mud must be of light enough consistency such that it may circulate through the drill bit to cool and lubricate the parts, but the mud must also be sufficiently viscous to carry the rock particulate debris away from the drill bit when the drill cuttings are circulated back up the well through the annular space. Typically, the circulating system pumps the mud drilling fluid down through the hollow drill string. The mud supplies the hydraulic power to operate the mud motor and cools and lubricates the drill bit as it flows through apertures in the drill bit. The mud may be a water-based, synthetic-based or diesel fuel-based product. Once the mud is circulated back up to the surface through the annular space, the cuttings are removed from the mud, for example, by way of a mesh before the mud is returned to the mud pits to be used again.

As the drilling fluid is pumped down the drill string and through the mud motor, pressure loss due to friction reduces the amount of pressure supplied to the motor, causing a decrease in motor torque and slower boring. Further pressure loss at the motor due to narrow flow passages also reduces the efficiency of drilling. By minimizing the pressure loss, the overall torque and hydraulic horsepower available to the motor may be increased. As such, there exists a need to provide a fluid driven drilling motor and system wherein pressure loss as the drilling fluid circulates through the drilling motor and system may be minimized to increase the drilling efficiency of the down-hole drilling motor.

Applicant is aware of several apparatus and methods in the art that purport to improve the efficiency of a down-hole motor. However, none of the prior art apparatus and methods minimize the pressure loss of the drilling fluid in the manner of the present invention. For example, applicant is aware of U.S. Pat. No. 6,561,290 to Blair et al. for a down-hole mud motor which has an improved bearing mandrel and a bearing stop to transfer a larger percentage of the weight of the drill string to the bit. Improved sealing systems for the transmission section and bearing section prevent drilling mud from entering critical components. A piston stop is provided to prevent the piston from damaging any parts as the piston moves under pressure. A compensating pressure disk is placed in the lower housing to prevent pressure from building up in the bearing section. A grooved ball seat is provided in the transmission to allow for greater flow of lubricant around the ball bearings.

Applicant is also aware of Canadian Patent No. 2,197,964 which issued to Sallwasser et al. on Dec. 3, 2002 for a Method and Apparatus for Drilling with a Flexible Shaft While Using Hydraulic Assistance. The apparatus and method disclosed includes applying thrust weight to a drill bit when drilling with a flexible drilling shaft while creating perforations in a cased well. The thrust is applied directly to the drill bit instead of applying it to the drill bit through the flexible drilling shaft. A support bracket is also in contact with a piston and is in slidable contact with the tool housing. A portion of the piston is positioned inside a chamber in the housing and is slidably attached to the chamber walls. As hydraulic fluid flows into the chamber opposite the piston, the piston is forced toward the drill bit. As the piston moves toward the drill bit, force is exerted on the support bracket which causes the bracket to move toward the drill bit. This force is transferred to the drill bit during the drilling process, thereby supplying the force needed by the drill bit to effectively drill through a desired material.

Applicant is also aware of U.S. Pat. No. 3,982,859 which issued to Tschirky et al. on Sep. 28, 1976 wherein the operation of hydraulic motors may be improved by employing stable flow restrictors which are resistant to corrosion and maintains a stable bypass volume of fluid used to lubricate the bearing package.

SUMMARY OF THE INVENTION

A fluid driven drilling motor and system for use in a drill string containing a down-hole drilling motor is disclosed. A rotor of the down-hole drilling motor rotates in a first direction relative to a stator about the longitudinal axis of a well bore in which the drill string is journalled. The rotor is operative under the pressure of a drilling fluid. In summary, the fluid driven drilling motor and system of the present invention may be characterized in one aspect as including a flex shaft mountable to and between the rotor and a cylindrical flow collar, the cylindrical flow collar having a cylindrical sidewall and first and second opposite ends. The first end of the cylindrical flow collar is mountable to the flex shaft. The second end of the cylindrical flow collar has a bore and is mountable to a drill bit so that the bore is in fluid communication with the drill bit.

At least one, and preferably two or more ramped apertures are formed in the side wall of the cylindrical flow collar. Each ramped aperture includes an inlet on an outer surface of the sidewall and a corresponding opening within the cylindrical flow collar such that the drilling fluid may be directed to the bore in the second end of the flow collar. The ramped apertures are therefore in fluid communication with the bore such that the drilling fluid may enter the bore via the inlets and the openings. Each of the ramped apertures include inclined ramp surfaces and inclined side surfaces extending radially, relative to a longitudinal axis of the bore, between the inlets and the corresponding openings. The ramped surfaces and side ramp surfaces are formed such that drilling fluid flowing under pressure down past the flex shaft may be directed and drawn into the ramped apertures along a fluid flow path which spirals downwardly and radially inwardly of the flow collar so as to then flow into the bore. The pressure loss associated with drawing the drilling fluid into the ramped apertures is thereby minimized such that increased hydraulic pressure is available to increase the overall torque and hydraulic power of the drill motor to increase drilling efficiency.

In an embodiment of the invention, the cylindrical flow collar includes a shear pin such that the shear pin may shear in the event of excess torsional stress, thereby inhibiting breakage of the drive shaft.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EMBODIMENTS OF THE INVENTION

Figure 1:
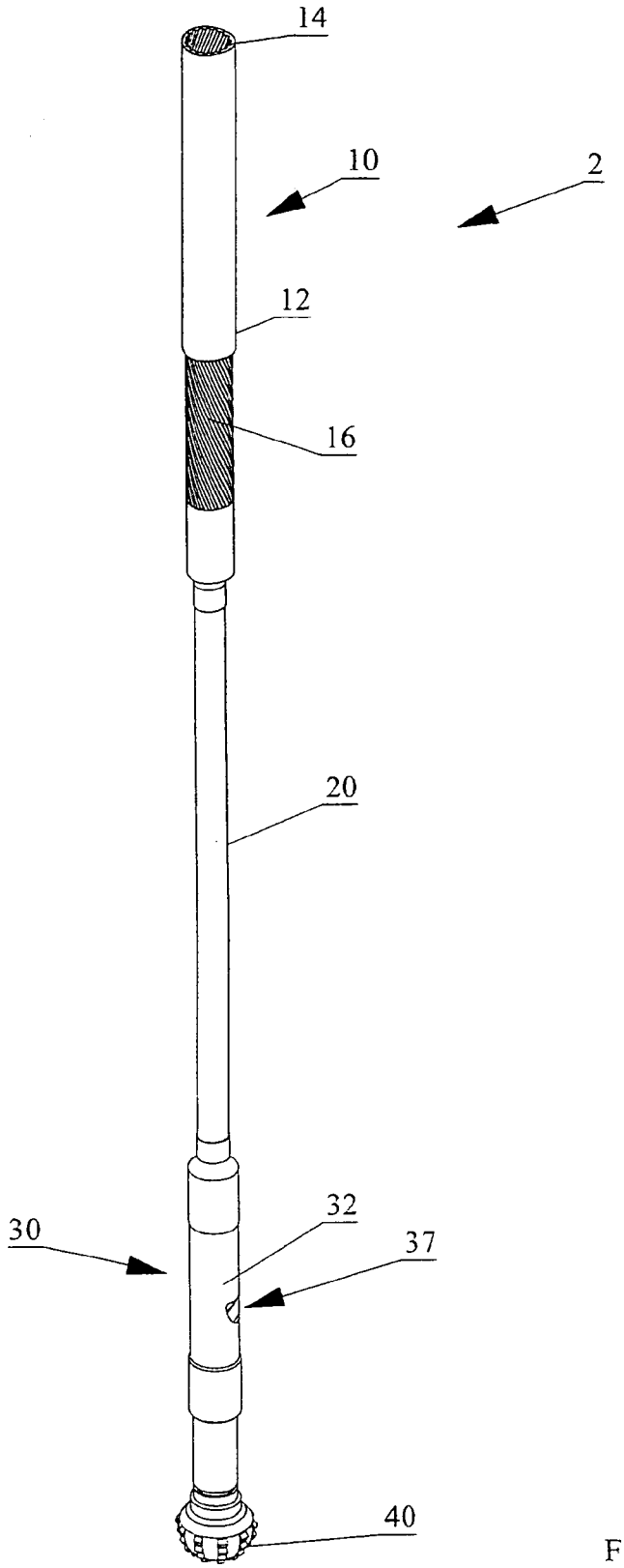
FIG. 1 is a partial cut away view of the fluid driven drilling motor and system according to the present invention.
Figure 2:
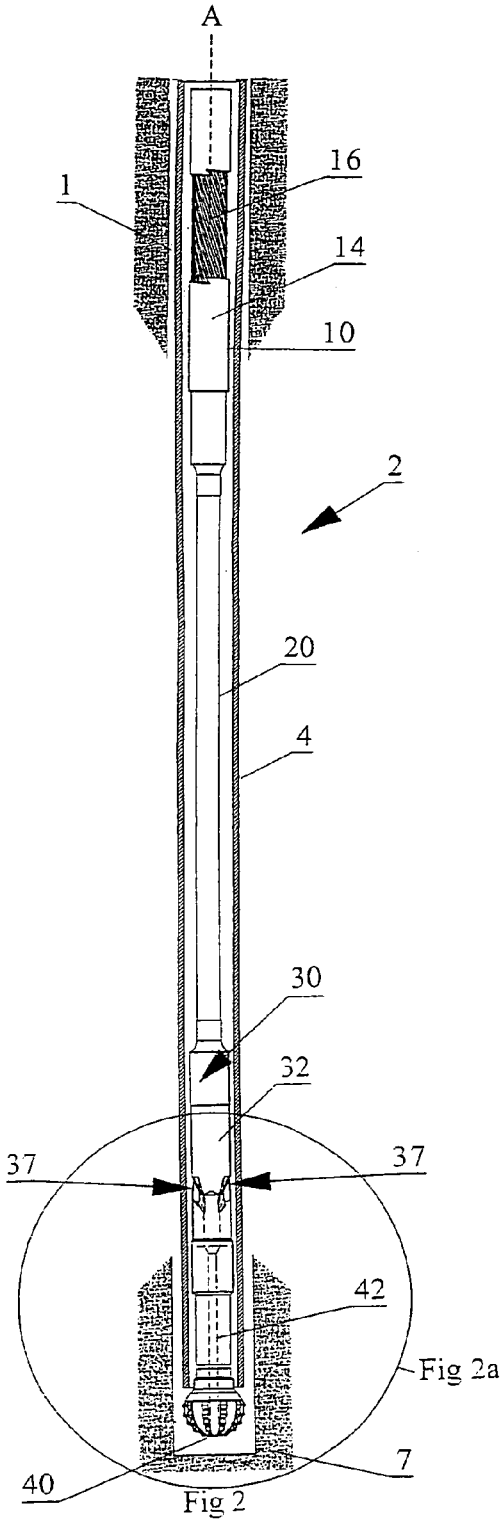
FIG. 2 is partial cut away view of the fluid driven drilling system of FIG. 1 journalled in and along a well bore.
Figure 2A:
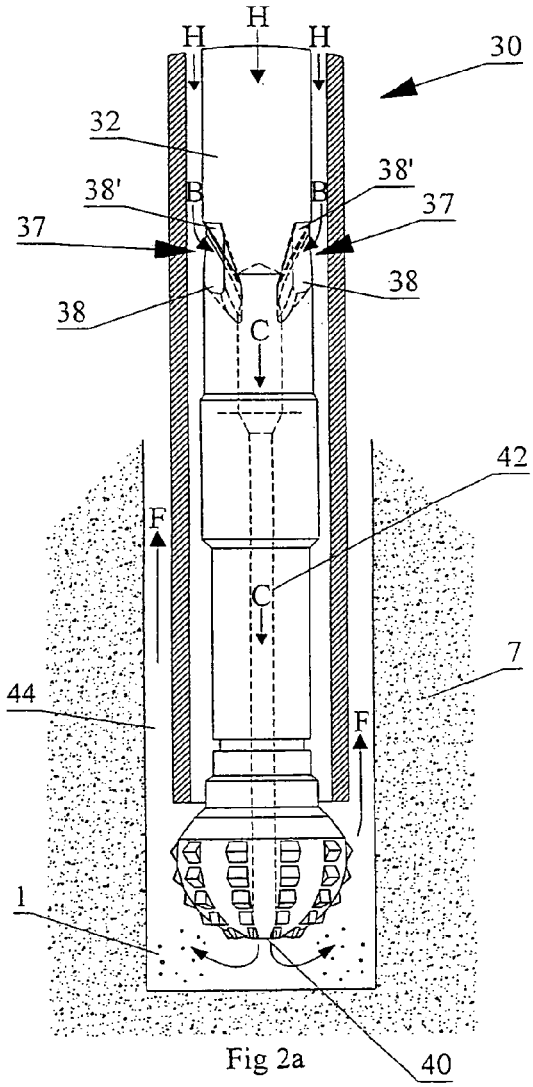
FIG. 2*a* is a sectional view of a lower end of the fluid driven drilling system of FIG. 2.

With reference to the FIGS. 1 to 5 wherein similar characters of reference denote corresponding parts in each view, the fluid driven drilling system according to the present invention includes a drill string 2 having a power section 10, a flex shaft 20, a flow collar 30, and a drill bit 40 coaxially mountable to each other. Power section 10, which includes a down-hole drilling motor 12, is coaxially mounted within a drill pipe (shown in FIG. 2) to flex shaft 20. Down-hole drilling motor 12 is of conventional design, such as described in U.S. Pat. Nos. 4,711,006 and 4,397,619 and incornorated herein by reference. Flex shaft 20 is coaxially mounted between power section 10 and flow collar 30. Down-hole drilling motor 12 is mounted to an upper end of flex shaft 20. Flow collar 30 is mounted to an opposite lower end of flex shaft 20. Flow collar 30 is mounted between flex shaft 20 and drill bit 40. An upper end of flow collar 30 is mounted to flex shaft 20. Alternatively, flow collar 30 may form the lower end of flex shaft 20, as described below. The lower end of flow collar 30 is configured to coaxially receive drill bit 40. Drill bit 40 is at the bottom-most end of drill string 2. Drill string 2 includes drill pipe 4. Drill string 2 is journalied in and down through a well bore 1 such that drill bit 40 engages and drills the rock formation 7.

Down-hole drilling motor 12 includes a stator 14 and a rotor 16 disposed in power section 10 of drill string 2. In an embodiment of the invention, down-hole drilling motor 12 is a mud motor or a positive displacement drilling motor that uses the hydraulic power of a drilling fluid, such as socalled mud, to rotate drill bit 40, as described below. Rotor 16 may be a chrome plated helically splined shaft having a series of projections that fit into corresponding channels of helically splined stator 14. Rotor 16 is rotatably journalled in helically splined stator 14 which defines a series of corresponding channels such that the series of projections of rotor 16 may mate with the series of channels defined by stator 14. Stator 14 spirals vertically down the length of power section 10. Stator 14 may be made of elastomer coated steel. The number of channels defined by stator 14 exceeds the number of projections on rotor 16, thereby creating a progressive series of cavities or spaces that extend vertically down the length of power section 10 as rotor 16 rotates relative to stator 14. As the drilling fluid is pumped down drill string 2 and flows through the series of cavities between stator 14 and rotor 16, the pressure of the drill fluid causes eccentric rotation of rotor 16 relative to stator 14 about the longitudinal axis A of power section 10. The ratio of rotor 16 projections and stator 14 channels may be varied to achieve the desired torque and speed. For example, a higher number of channels and projections yield a higher torque and slower speed whereas a fewer number of channels and projections yield a lower torque and higher speed.

The upper end of flex shaft 20 is coaxially mounted to the bottom end of rotor 16 by coupling means known in the art, such as a combined splined/threaded coupling. In an embodiment of the invention, flex shaft 20 is cylindrical and may be made of solid alloy steel or any other heavy duty material such that flex shaft 20 may convert the eccentric rotation of rotor 16 to smooth concentric rotation at the lower end of flex shaft 20 to ensure concentric rotation of a drive shaft 42 to rotate drill bit 40. Flex shaft 20 also transmits the torque generated by down-hole drilling motor 12 from power section 10 to flow collar 30 to drive shaft 42 to rotate drill bit 40.

Figure 3:
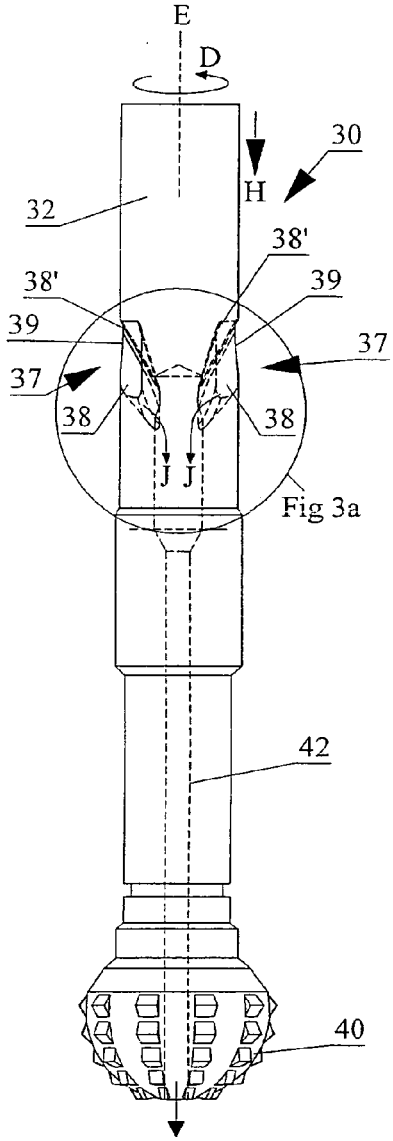
FIG. 3 is a front view of a flow collar and a drill bit coaxially mounted together.
Figure 3A:
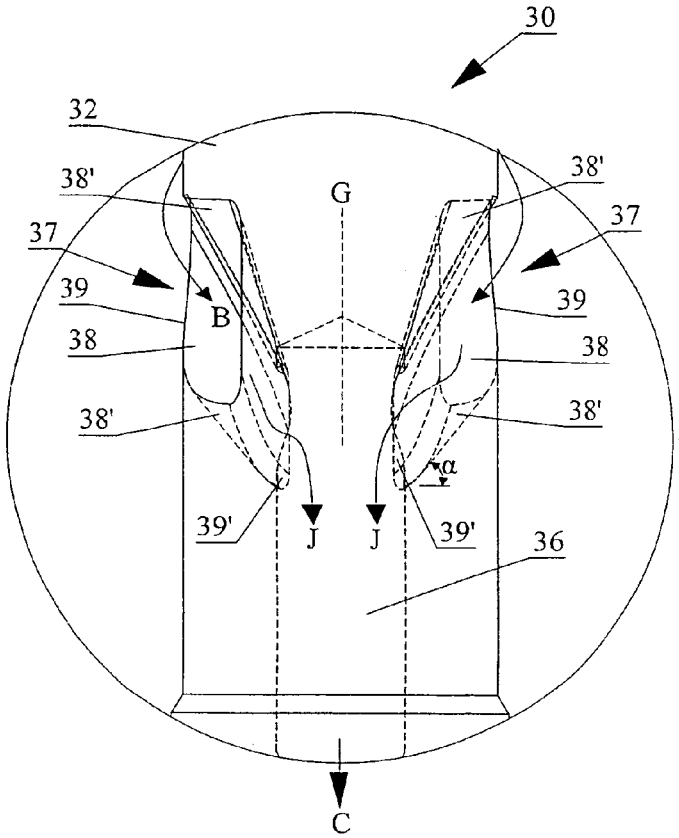
FIG. 3*a* is a sectional view of the flow collar of FIG. 3.
Figure 3B:
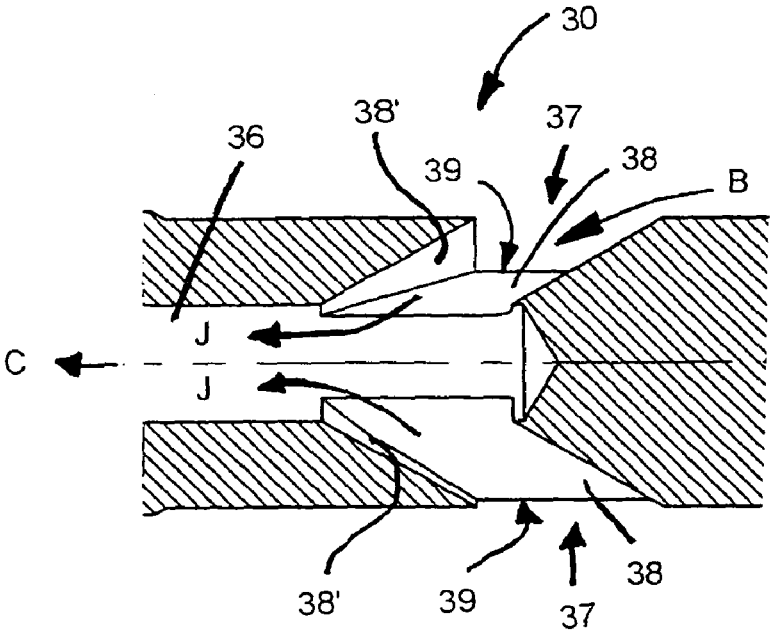
FIG. 3*b* is a cross-sectional view through axis G in FIG. 3*a*.
Figure 4:
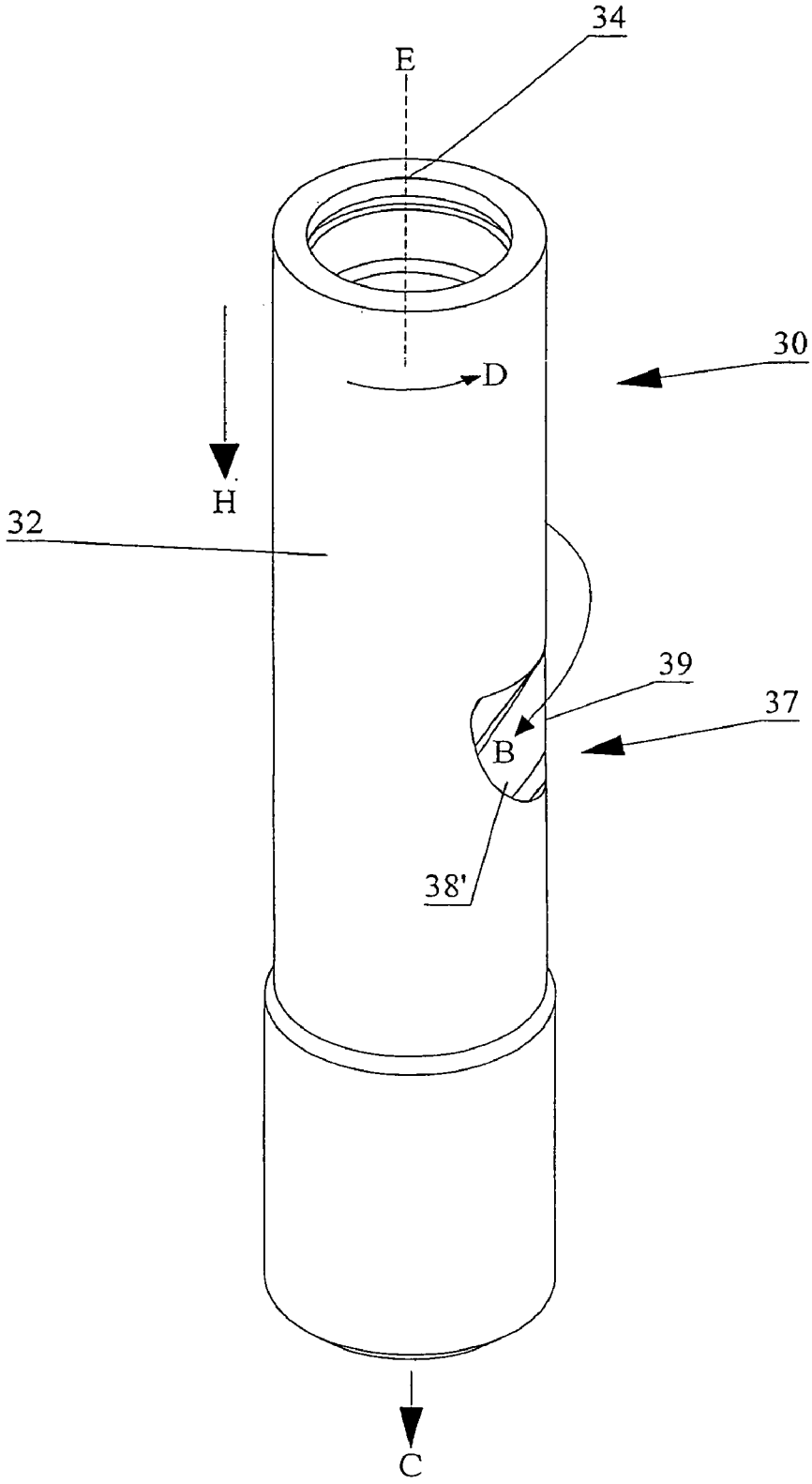
FIG. 4 is a perspective view of the flow collar of FIG. 3.
Figure 5:
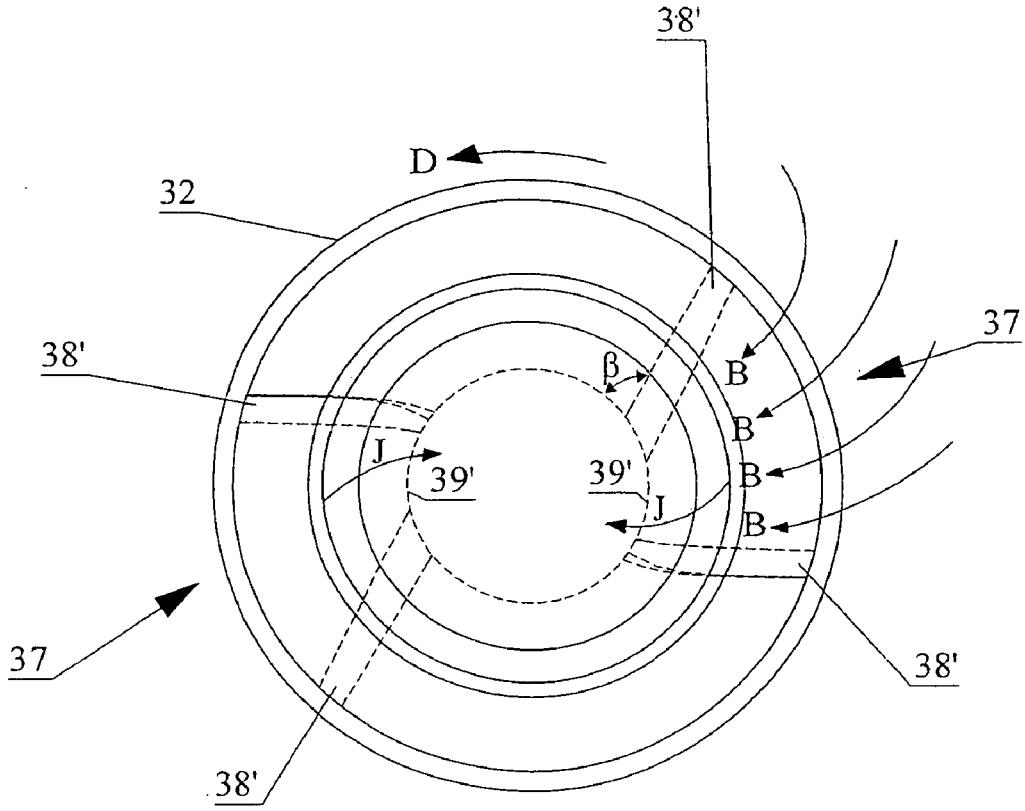
FIG. 5 is a plan view of the flow collar shown in FIG. 3.

In an embodiment of the invention, the lower end of flex shaft 20 is coaxially mounted to upper end of flow collar 30 by for example a threaded coupling or other coupling means known in the art. Alternatively, flex shaft 20 and flow collar 30 may be a single unitary structure. For example, the lower end of flex shaft 20 may include flow collar 30 such that flow collar 30 is formed at the lower end of, and as a part of, flex shaft 20. In the former embodiment of the invention, flow collar 30 defines an upper bore 34, as seen in FIG. 4, at an upper end of flow collar 30 to receive and mate with a lower portion of flex shaft 20. Flow collar 30 may also define a lower bore 36, seen in FIG. 3*a*, to receive and mate with drive shaft 42 at the lower end of flow collar 30. In a preferred embodiment of the invention, flow collar 30 is cylindrical, having a cylindrical sidewall 32 and a diameter larger than flex shaft 20. At least one, and preferably two or more ramped apertures 37 are formed in sidewall 32 of flow collar 30. Flow collar 30 may be made of steel. Ramped apertures 37 may be hardened using a nitride or carbide coating process to inhibit corrosion.

Each ramped aperture 37 includes an inlet 39 on an outer surface of sidewall 32 where the drilling fluid may enter flow collar 30. Ramped apertures 37 are in fluid communication with lower bore 36 via inlets 39 and openings 39' such that when the drilling fluid enters ramped apertures 37 in directions B via inlets 39, the drilling fluid flows through openings 39' and into lower bore 36. The drilling fluid continues to flow down and through lower bore 36 and drive shaft 42 in direction C to lubricate and cool drill bit 40 while flow collar 30 rotates concentrically in direction D relative to longitudinal axis of rotation E. The drilling fluid flows out of drill bit 40 via a plurality of apertures such that the drilling fluid may transport drill cuttings to the surface through the annular space 44 in direction F when the drilling fluid is pumped back up to the surface.

Each of the ramped apertures 37 include inclined ramp surfaces 38 and side inclined ramp surfaces 38' extending radially, relative to longitudinal axis G of lower bore 36, between inlets 39 and openings 39'. Preferably, the drilling fluid flows down a generally thirty degree ramp (see angle $\alpha$ of FIG. 3*a*) of inclined ramp surfaces 38 and a generally sixty degree ramp (see angle $\beta$ of FIG. 5) of side inclined ramp surfaces 38' into lower bore 36. Inclined ramp surfaces 38 and side inclined ramp surfaces 38' are formed such that drilling fluid flowing under pressure down the outside of flex shaft 20 in direction H is directed and drawn into ramped apertures 37 via inlets 39 along fluid flow path J which spirals downwardly and radially inwardly of flow collar 30. In an embodiment of the invention, ramped apertures 37 are machined in a spiraled configuration such that drilling fluid may be easily drawn down inclined ramp surfaces 38 and side inclined ramp surfaces 38' and into lower bore 36 via inlets 39 and openings 39' due to the pressure difference between the pressure within lower bore 36 and the flow pressure of the drilling fluid. Advantageously, the pressure loss associated with drawing the drilling fluid into ramped apertures 37 is minimal, therefore more pressure is available to increase the overall torque and hydraulic power of down-hole drilling motor 12 to increase drilling efficiency.

During the process of converting the eccentric rotary motion of rotor 16 to concentric rotary motion, a large amount of stress may be induced into flex shaft 20. More particularly, the torque generated by the rotation of rotor 16 relative to stator 14 and the additional torque generated by the rotation of drill bit 40 creates torsional or shear stress along flex shaft 20. Excessive torsional stress may damage the flex shaft 20 or the drive shaft 42. Consequently in one embodiment, flow collar 30 may includes shear pins such that the shear pins shear under excessive torsional stress, thereby inhibiting damage to the flex shaft or drive shaft.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A fluid driven down-hole drilling motor having a rotor which rotates in a first direction relative to a stator about a longitudinal axis of a well bore in which a drill string containing the motor is journalled, the rotor operative under the pressure of a drilling fluid, the drilling motor including a flex shaft mountable to the rotor, the drilling motor comprising a cylindrical flow collar mountable at a first end thereof to an opposite end of the flex shaft opposite to the rotor, said cylindrical flow collar having a cylindrical sidewall and a second end opposite said first end wherein said second end of said flow collar has a bore and is mountable to a hollow drill bit so that said bore is in fluid communication with the drill bit, wherein at least one ramped aperture is formed in said side wall of said flow collar, each ramped aperture including an inlet on an outer surface of said sidewall and a corresponding opening within said flow collar such that the drilling fluid may be directed to the bore in the second end of the flow collar, said at least one ramped aperture in fluid communication with said bore such that the drilling fluid enters said bore via, sequentially, said inlet and said opening, wherein said each ramped aperture includes an inclined ramp surface and an inclined side surface extending radially, relative to a longitudinal axis of the bore, between said inlet and said opening, said ramped surface and side ramp surface formed such that the drilling fluid flowing under pressure down past the flex shaft is directed and drawn into said ramped aperture along a fluid flow path which spirals downwardly and radially inwardly of said flow collar so as to then flow into said bore, whereby pressure loss associated with drawing the drilling fluid into said at least one ramped aperture is thereby minimized.

2. The device of claim 1, wherein said inclined ramp is inclined substantially 30 degrees relative to a plane orthogonal to said longitudinal axis of the bore.

3. The device of claim 2, wherein said inclined side surface is inclined substantially 60 degrees relative to a tangent to an inner surface of said bore at said opening into said bore.

4. The device of claim 1 wherein said inclined ramp is inclined into said first direction so as to advance said inlet ahead of said opening as said flow collar is rotated in said first direction.

5. A flow collar for a fluid driven down-hole drilling motor, the flow collar comprising:

a substantially cylindrical side wall and a bore formed in a downstream end, at least one ramped aperture formed in said side wall and in fluid communication with a spiraled passageway in said side wall spiraling radially inwardly through said side wall and to said bore, said spiraled passageway in fluid communication with said bore, wherein pressure loss associated with drilling fluid entering into said at least one ramped aperture is minimized by said at least one ramped aperture forming a gradual flow entry into said passageway and said passageway forming a gradual radially inward spiral so as to communicate the drilling fluid to said bore wherein sharp changes in direction of said flow, which would cause increased pressure loss, are minimized, wherein each ramped aperture includes an inlet on an outer surface of said sidewall and a corresponding opening within said flow collar such that the drilling fluid may be directed to said bore in a second end of the flow collar, said at least one ramped aperture in fluid communication with said bore such that the drilling fluid enters said bore via, secuentially, said inlet and said opening, and wherein said each ramped aperture includes an inclined ramp surface and an inclined side surface extending radially, relative to a longitudinal axis of the bore, between said inlet and said opening, said ramped surface and side ramp surface formed such that the drilling fluid flowing under pressure down past a first end of the flow collar opposite said second end is directed and drawn into said ramped aperture along a fluid flow path of said spiraled passageway.

6. The device of claim 5, wherein said inclined ramp is inclined substantially 30 degrees relative to a plane orthogonal to said longitudinal axis of the bore.

7. The device of claim 6, wherein said inclined side surface is inclined substantially 60 degrees relative to a tangent to an inner surface of said bore at said opening into said bore.

8. The device of claim 5, wherein said inclined ramp is inclined into said first direction so as to advance said inlet ahead of said opening as said flow collar is rotated in a first direction.

* * * * *